US005779352A

United States Patent [19]

Lin

[11] Patent Number: 5,779,352

[45] Date of Patent: Jul. 14, 1998

[54] DECORATION LAMP DEVICE

[76] Inventor: Mei-Lu Lin, 56, Min Sheng Street, Fengyuan Taichung Hsien, Taiwan

[21] Appl. No.: 953,875

[22] Filed: Oct. 18, 1997

[51] Int. Cl.[6] ..... F21P 1/02

[52] U.S. Cl. ..... 362/249; 362/252; 362/806; 362/396

[58] Field of Search ..... 362/249, 252, 362/396, 103, 806, 391, 123; 439/475, 460

[56] References Cited

U.S. PATENT DOCUMENTS 5,418,698 5/1995 Wu ..... 362/252

5,428,516 6/1995 Harris ..... 362/249

5,669,707 9/1997 Huang ..... 362/249

5,709,462 1/1998 Rumpel ..... 362/249

*Primary Examiner*—Thomas M. Sember

[57] ABSTRACT

A decoration lamp device has a bulb and a lamp holder receives the bulb. Two conductive copper wires extend outward of the lamp holder and a socket receives the lamp holder. A first L-shaped rod and a second L-shaped rod are disposed on the socket. A post is disposed on the socket, and two electric wires extend outward of the socket. A retainer plate has a slot receiving the post. The post is bent to be inserted in the slot.

6 Claims, 7 Drawing Sheets

DECORATION LAMP DEVICE

BACKGROUND OF THE INVENTION

This invention relates to a decoration lamp device, and more particularly, this invention relates to a decoration lamp device which can be positioned on a net stably.

A conventional decoration lamp device can be disposed on a fabric. However, the fabric should perforate a plurality of holes to receive a plurality of conventional decoration lamps. A conventional decoration lamp device can be disposed on a net also. However, the user has to use a large number of clamps to position a plurality of conventional decoration lamps on the net.

SUMMARY OF THE INVENTION

An object of this invention is to provide a decoration lamp device which can be positioned on a net stably.

Another object of this invention is to provide a decoration lamp device which can be assembled easily.

Another object of this invention is to provide a decoration lamp device which can be assembled quickly.

DETAILED DESCRIPTION OF THE INVENTION

Figure 1:
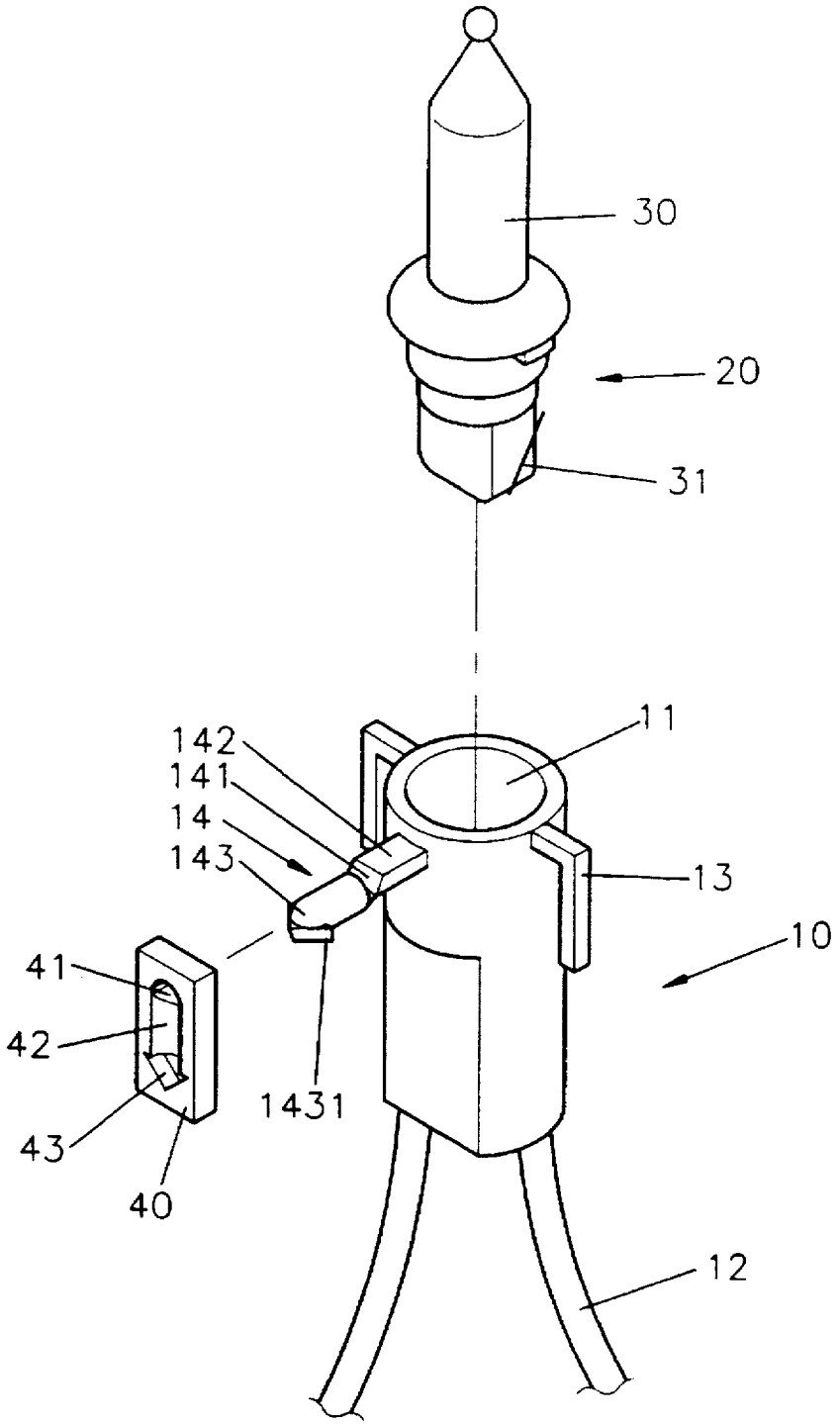
FIG. 1 is a perspective exploded view of a decoration lamp device of a first preferred embodiment.
Figure 2:
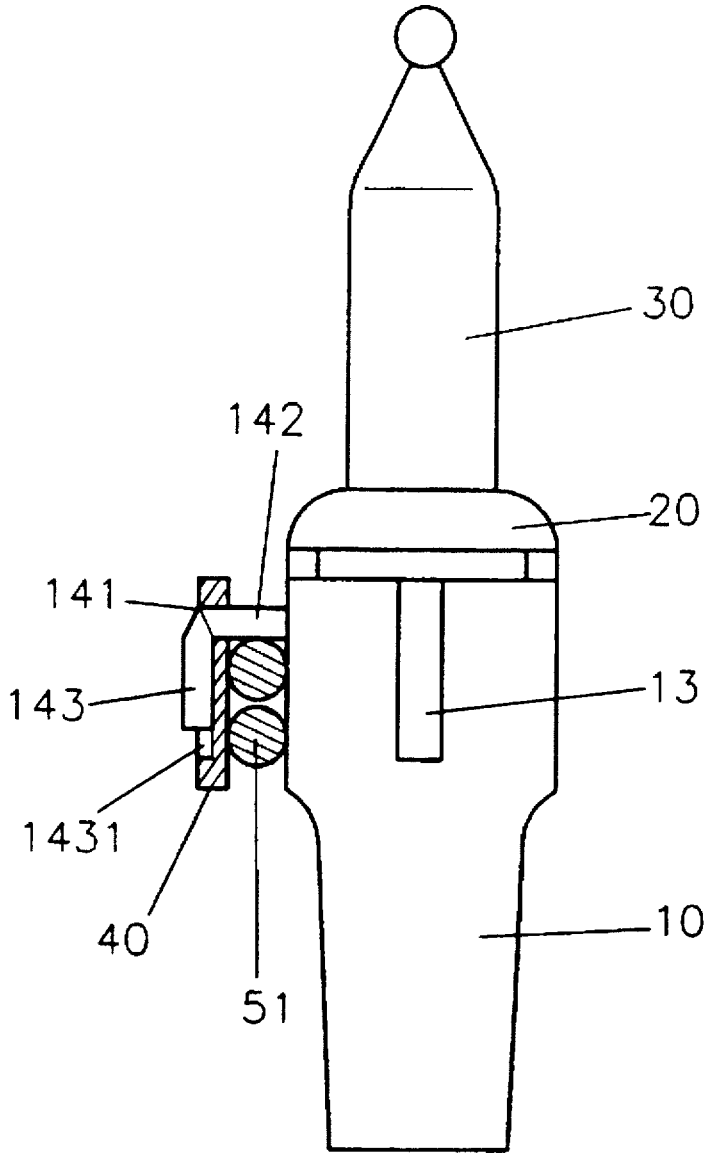
FIG. 2 is a partially sectional view illustrating a decoration lamp device of a first preferred embodiment positioned on a net.
Figure 3:
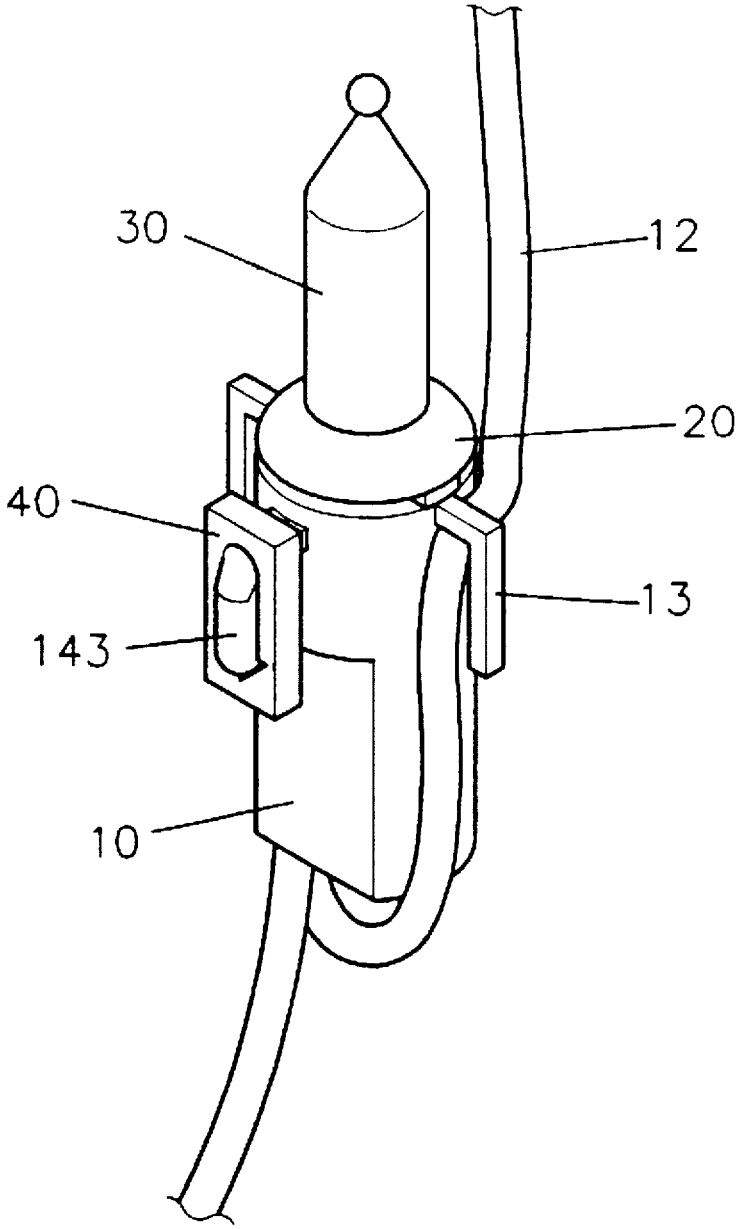
FIG. 3 is a perspective asssembly view of a decoration lamp device of a first preferred embodiment.

Referring to FIGS. 1 to 3, a decoration lamp device comprises a bulb 30, a lamp holder 20 receiving the bulb 30, two conductive copper wires 31 extending outward of the lamp holder 20, a socket 10 receiving the lamp holder 20, a first L-shaped rod 13 disposed on the socket 10 extending downward, a second L-shaped rod 13 disposed on the socket 10 extending downward, a post 14 disposed on the socket 10, and two electric wires 12 extending outward of the socket 10. A retainer plate 40 has a slot 42 receiving the post 14. The post 14 is bent to be inserted in the slot 42. The electric wires 12 are positioned by the first L-shaped rod 13 and the second L-shaped rod 13 respectively.

Two conductive plates (not shown in the figures) are disposed in the socket 10 contacting the conductive copper wires 31 respectively.

The retainer plate 40 has a semi-circular groove 41 and a triangular groove 43 communicating with the slot 42.

The post 14 has a bar 142, a flexible rod 143, and a recess groove 141 formed between the bar 142 and the flexible rod 143. The flexible rod 143 has a triangular tip end 1431. When the flexible rod 143 is bent, the triangular tip end 1431 is inserted in the triangular groove 43.

Figure 4:
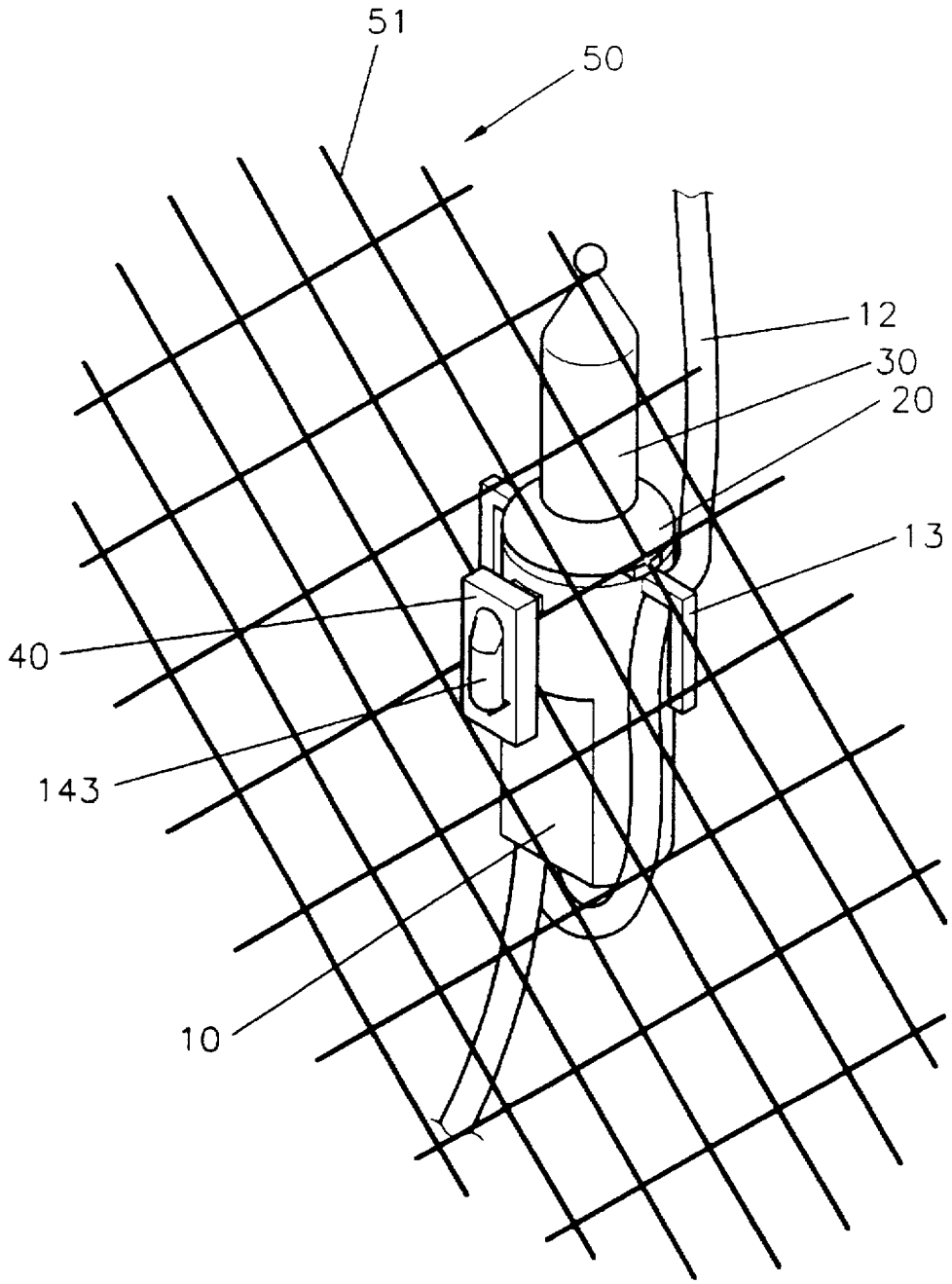
FIG. 4 is a perspective schematic view illustrating a decoration lamp device of a first preferred embodiment positioned on a net.

Referring to FIGS. 2 to 4, the post 14 passes through a mesh defined by a plurality of threads 51 of a net 50. Then the post 14 is inserted in the slot 42. Then the flexible rod 143 is bent until the triangular tip end 1431 is inserted in the triangular groove 43. Then the electric wires 12 are positioned by the first L-shaped rod 13 and the second L-shaped rod 13 respectively.

Figure 5:
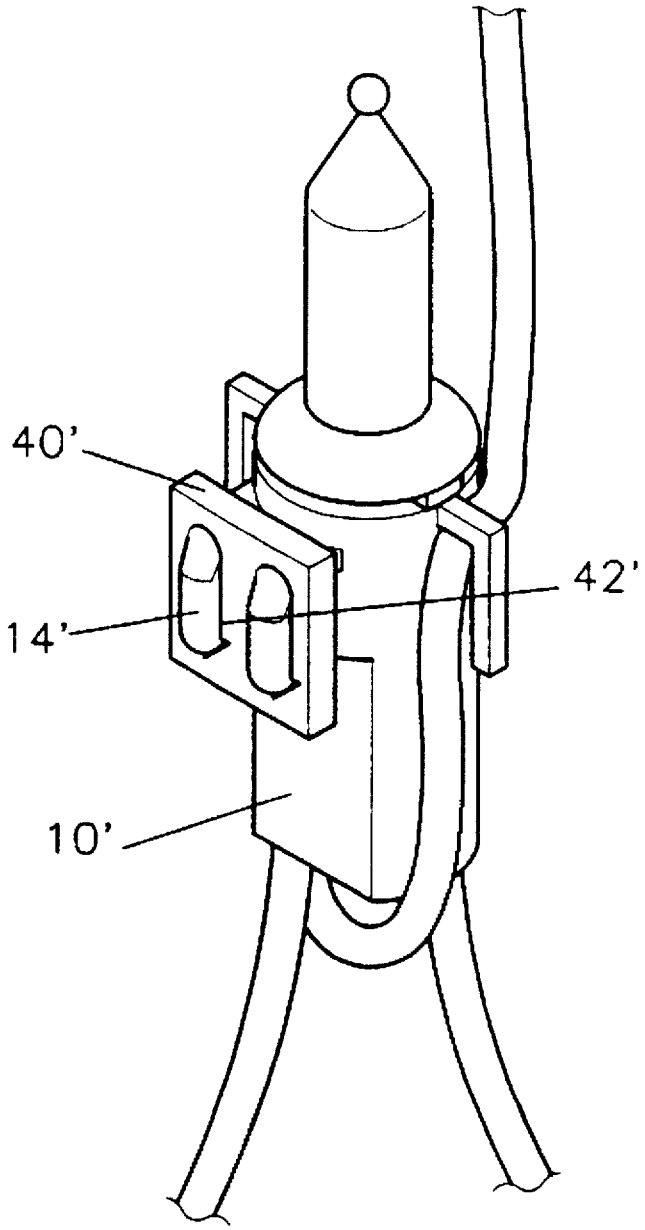
FIG. 5 is a perspective asssembly view of a decoration lamp device of a second preferred embodiment.

Referring to FIG. 5, a second decoration lamp device comprises a socket 10', two posts 14' disposed on the socket 10', a retainer plate 40', and two slots 42' formed on the retainer plate 40' receiving the posts 14'.

Figure 6:
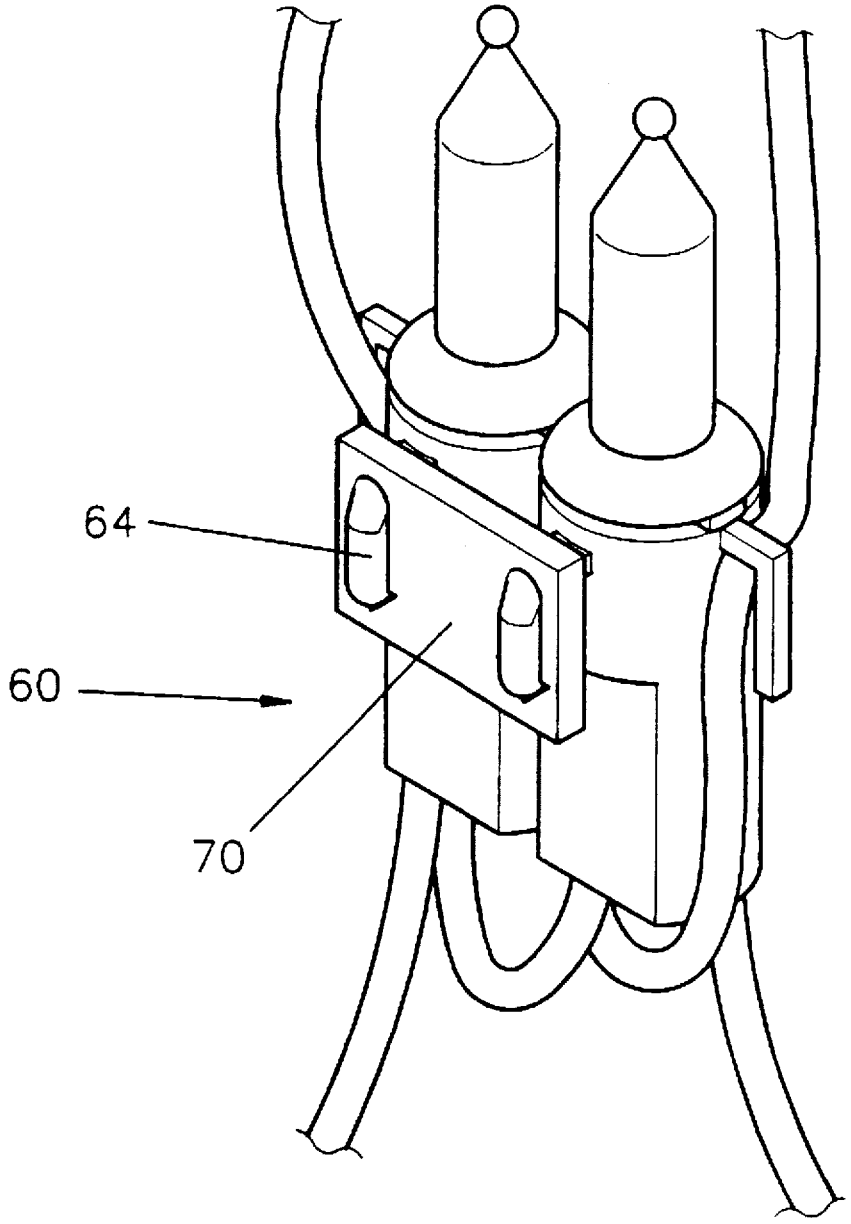
FIG. 6 is a perspective asssembly view of a decoration lamp device of a third preferred embodiment.

Referring to FIG. 6, a third decoration lamp device comprises a tandem socket 60, two posts 64 disposed on the tandem socket 60, a retainer plate 70, and two slots formed on the retainer plate 70 receiving the posts 64.

Figure 7:
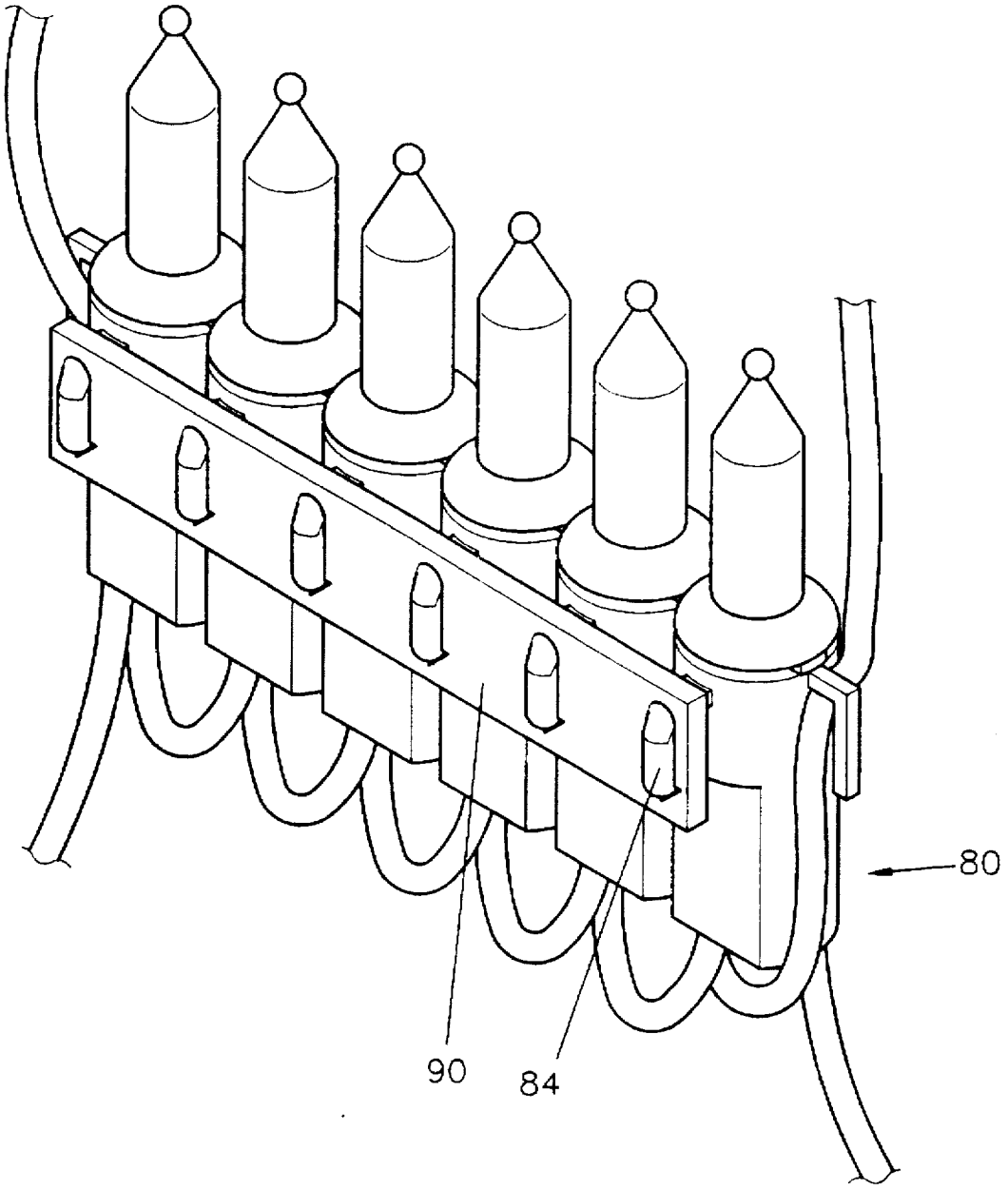
FIG. 7 is a perspective asssembly view of a decoration lamp device of a fourth preferred embodiment.

Referring to FIG. 7, a fourth decoration lamp device comprises a gang socket 80, a plurality of posts 84 disposed on the gang socket 80, a retainer plate 90, and a plurality of slots formed on the retainer plate 90 receiving the posts 84.

I claim:

1. A decoration lamp device comprises:

a bulb, a lamp holder receiving the bulb, a socket receiving the lamp holder, a first L-shaped rod disposed on the socket, a second L-shaped rod disposed on the socket, a post disposed on the socket, a retainer plate having a slot receiving the post, the post bent to be inserted in the slot.

2. A decoration lamp device as claimed in claim 1, wherein the retainer plate further has a semi-circular groove and a triangular groove communicating with the slot.

3. A decoration lamp device as claimed in claim 1, wherein the post has a bar 142, a flexible rod 143, and a recess groove 141 formed between the bar 142 and the flexible rod 143.

4. A decoration lamp device as claimed in claim 3, wherein the flexible rod has a triangular tip end.

5. A decoration lamp device as claimed in claim 1, wherein an addtional post is disposed on the socket.

6. A decoration lamp device as claimed in claim 1, wherein an addtional slot is formed on the retainer plate.

* * * * *